United States Patent [19]

Marschke

[11] 4,235,432

[45] Nov. 25, 1980

[54] SHEET FEEDING

[75] Inventor: Carl R. Marschke, Phillips, Wis.

[73] Assignee: Marquip, Inc., Phillips, Wis.

[21] Appl. No.: 920,654

[22] Filed: Jun. 30, 1978

[51] Int. Cl.[3] ..... B65H 3/08; B65H 5/06

[52] U.S. Cl. ..... 271/11; 271/31; 271/104; 271/112; 271/124; 271/153

[58] Field of Search ..... 271/112, 117, 124, 121, 271/126, 153, 154, 155, 30 R, 31, 109, 148, 10–17, 34, 167, 138, 104; 414/118, 121, 123, 124

[56] References Cited

U.S. PATENT DOCUMENTS

| | | | |
|---|---|---|---|
| 2,808,260 | 10/1957 | Rünzi | 271/125 |
| 3,173,681 | 3/1965 | David et al. | 271/155 X |
| 3,351,196 | 11/1967 | Van Laanen | 271/12 X |
| 3,391,926 | 7/1968 | Jaatinen | 271/112 |
| 3,661,381 | 5/1972 | Kuzniak | 271/112 X |
| 3,827,576 | 8/1974 | Ward et al. | 271/121 X |

*Primary Examiner*—Bruce H. Stoner, Jr.
*Attorney, Agent, or Firm*—Andrus, Sceales, Starke & Sawall

[57] ABSTRACT

A floating feed device is adapted to be engaged by the top sheet in a rising stack and to feed the sheet downstream. The mount for the feed device is articulated, and the device includes a vacuum chamber and horizontal drive rollers. A narrow slot is formed between a guide roller of the feed device and a gate which is disposed in the plane of a stack back-up plate and which is vertically movable in said plane. A control is provided to maintain the same slot width, no matter what the articulated position of said guide roller, by automatically adjusting the gate vertically with the guide roller. The feed device is caused to articulate about its mount upon engagement by a rising stack, and such articulation causes a resultant change in the speed of the stack lift drive.

3 Claims, 10 Drawing Figures

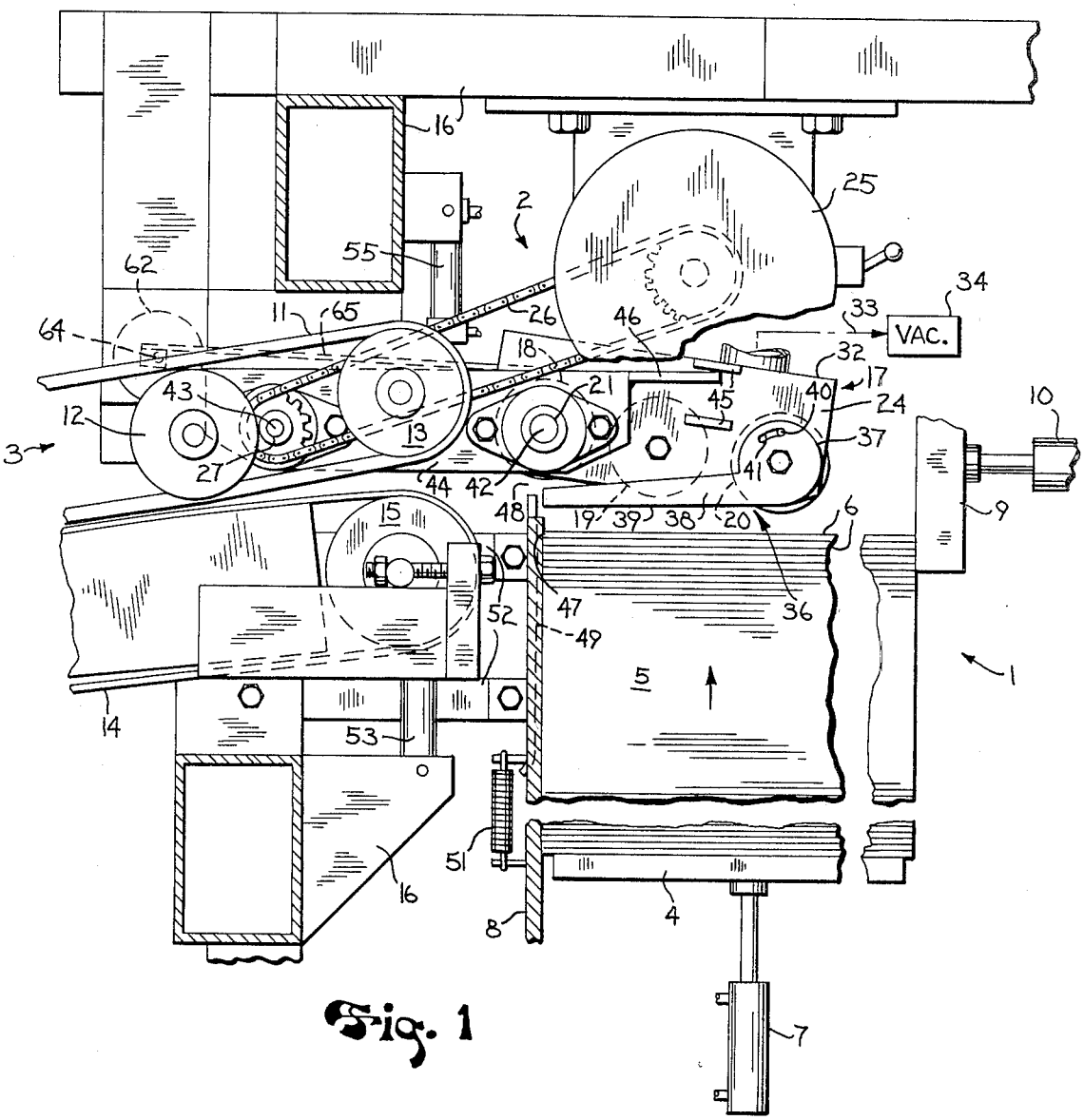
Fig. 1
Fig. 10
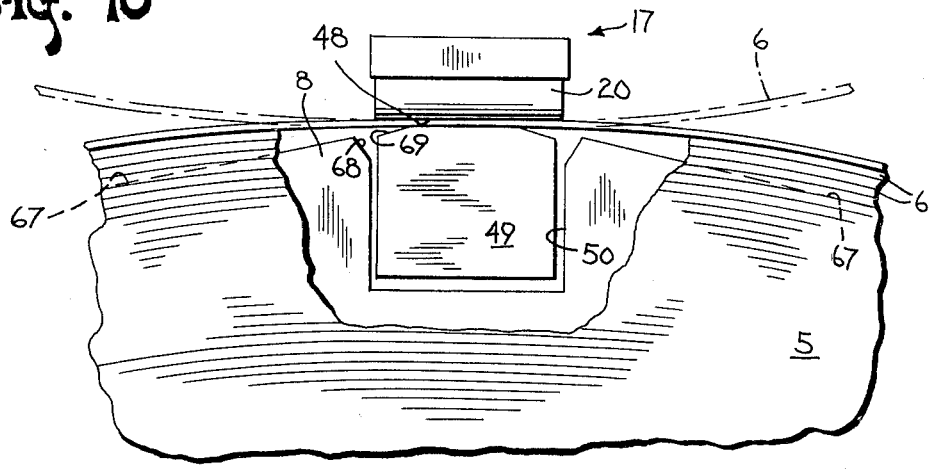

Fig. 7
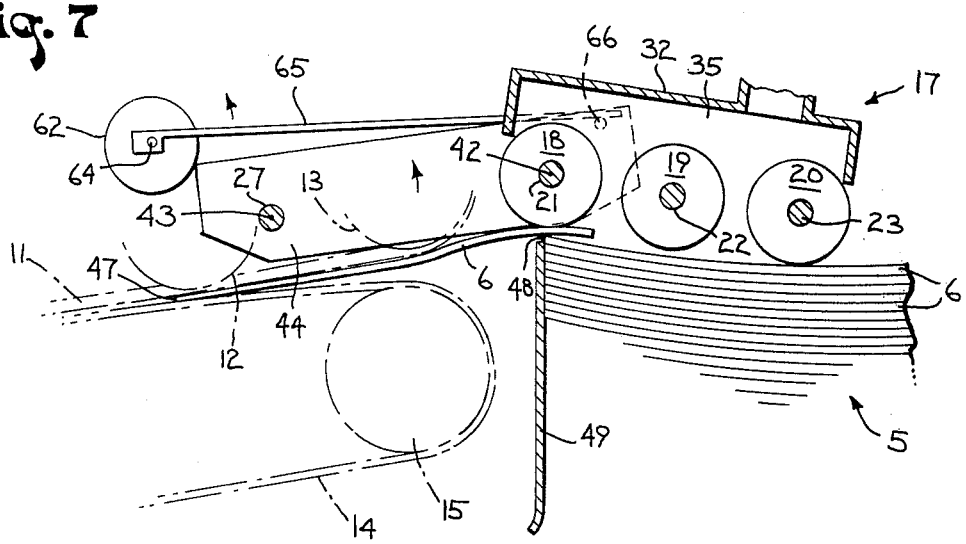
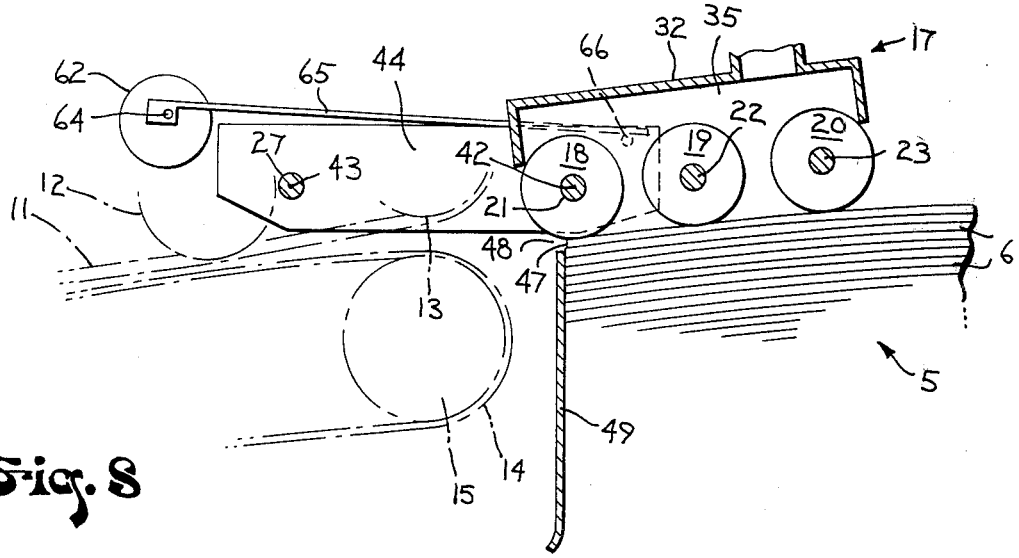
Fig. 8
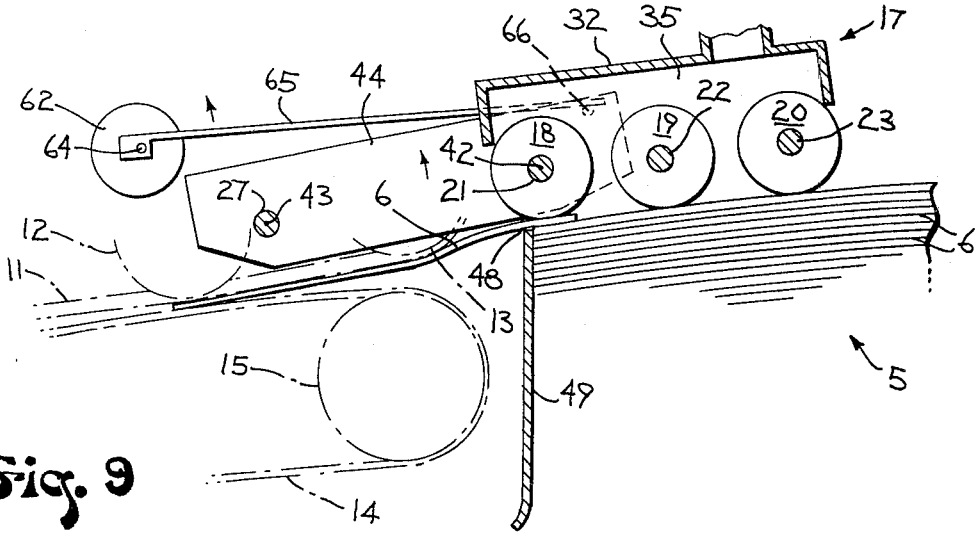
Fig. 9

SHEET FEEDING

BACKGROUND AND SUMMARY OF THE INVENTION

This invention relates to sheet feeding, and more particularly to the feeding of sheets of corrugated cardboard and the like from a stack to a downstream apparatus such as a conveyor.

It has long been known to place a stack of sheets on a vertically movable platform and feed the sheets off the top of the stack one at a time in succession while raising the platform. Various feeding devices have been utilized in connection with this concept.

One of the most difficult problems in sheet feeding is that of sheet warpage. If the sheets in the stack are warped and the feeding device receives a warped sheet from the top of the stack, the sheet may jam in the apparatus. This is especially true at high speeds, such as 1000 ft./min.

It is a task of the present invention to provide a concept wherein, broadly, sheet material which is either flat or warped may be efficiently and quickly fed from the top of a stack with little or no opportunity for jamming and the resultant possible damage to the sheet material and/or the feeding apparatus.

It is a further task of the invention to provide a way to feed such sheet material through a narrow slot without said jamming.

It is yet another task of the invention to automatically control the stack lifting operation so that there is cooperation with the sheet material feeding operation.

In accordance with one aspect of the invention, a floating feed device is adapted to be engaged by the top sheet in the rising stack and to feed the sheet downstream. The mount for the feed device is articulated, and the device includes a vacuum chamber and horizontal drive rollers.

In accordance with another aspect of the invention, a narrow slot is formed between a guide roller of the feed device and a gate which is disposed in the plane of a stack back-up plate and which is vertically movable in said plane. A control is provided to maintain the same slot width, no matter what the articulated position of said guide roller, by automatically adjusting the gate vertically with the guide roller.

In accordance with a further aspect of the invention, the feed device is caused to articulate about its mount upon engagement by a rising stack, and such articulation causes a resultant change in the speed of the stack lift drive.

BRIEF DESCRIPTION OF THE DRAWINGS

The accompanying drawings furnished herewith illustrate the best mode presently contemplated by the inventor for carrying out the invention.

In the drawings:

FIG. 1 is a side elevation of a device constructed in accordance with the concepts of the invention and with parts broken away and in section;

FIGS. 6 and 7 show several articulated positions of the head during handling of sheets which have an upwardly concave longitudinal warp;

FIGS. 8 and 9 show several articulated positions of the head during handling of sheets which have an upwardly convex longitudinal warp; and FIG. 10 is a schematic rear end view of the feeding area and showing the handling of transversely warped sheets.

DESCRIPTION OF THE PREFERRED EMBODIMENT

Figure 2:
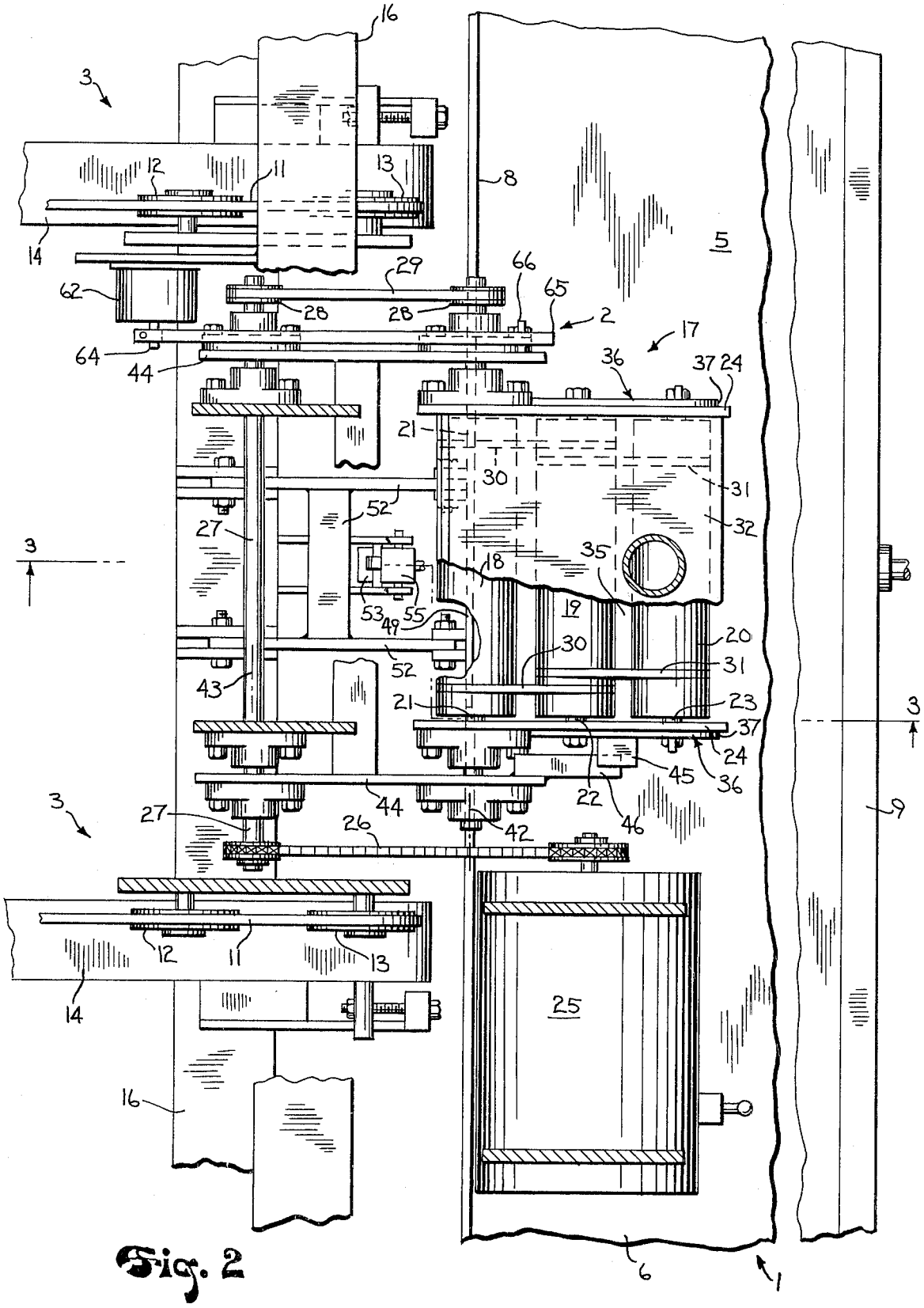
FIG. 2 is a top plan view of the device with parts broken away and in section.
Figure 3:
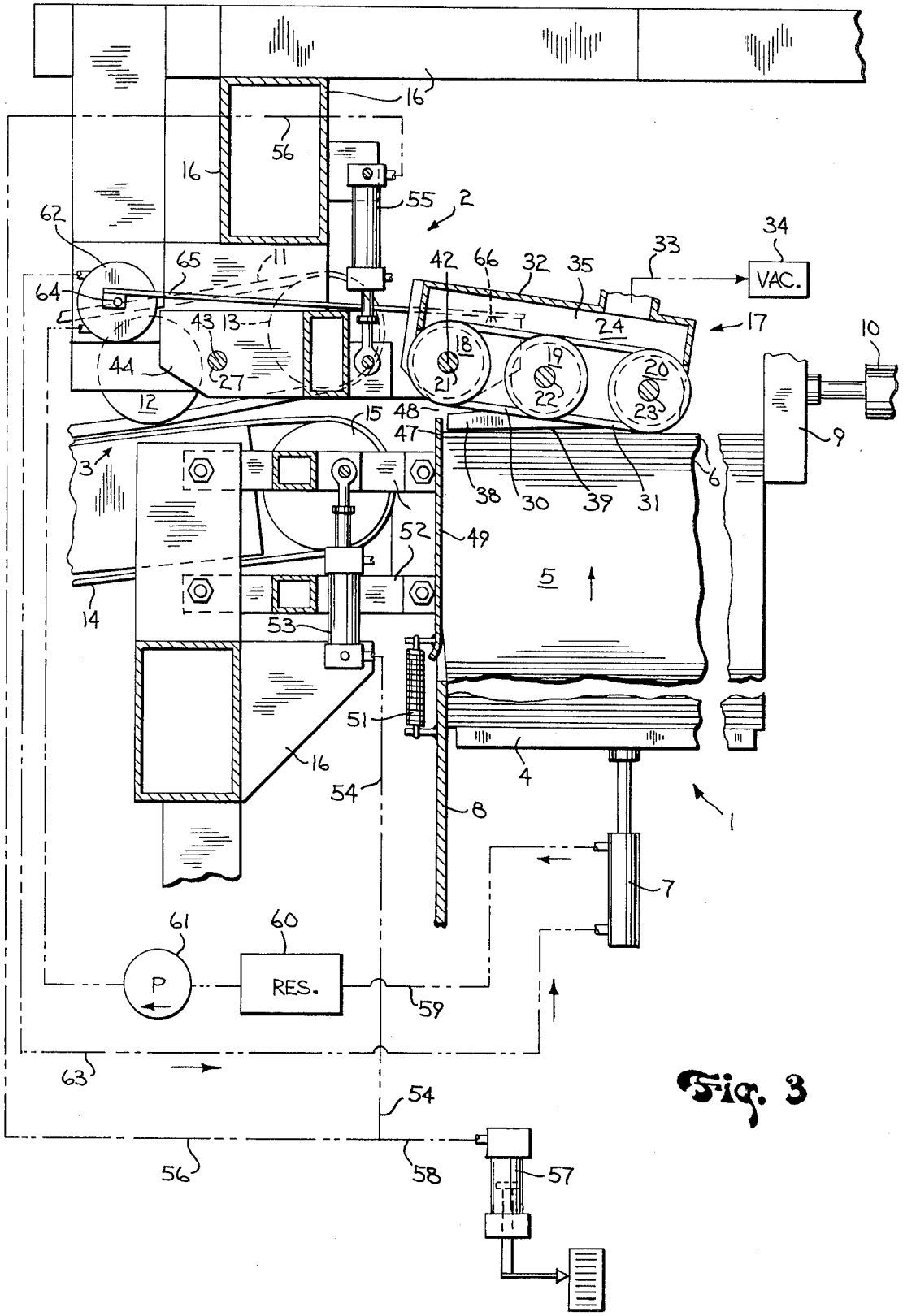
FIG. 3 is a longitudinal section taken on line 3—3 of FIG. 2 and showing the control circuitry.

As best shown in FIGS. 1–3, the concepts of the invention are adapted to be utilized in a machine for feeding sheet material such as corrugated cardboard and the like. Broadly, the machine may include a stack lift station 1, a sheet feeding station 2 and a downstream sheet receiving apparatus 3.

Stack lift station 1 may be of any suitable type and is shown herein as a platform 4 adapted to hold a stack 5 of individual sheets 6. Platform 4 is adapted to be raised by an hydraulic cylinder 7. A vertical backup plate 8 is disposed just forwardly of platform 4 and extends upwardly from adjacent the lowermost platform position to adjacent station 2. A pusher 9 attached to a suitable drive cylinder 10 is disposed adjacent the input area of station 2 and is adapted to conform the top few sheets of stack 5 by pushing them against plate 8.

Sheet receiving apparatus 3 may also be of any suitable desired type and is shown in this instance as pairs of transversely spaced upper belt coneyors 11 trained about front and rear pulleys 12,13 respectively, and a pair of lower belt conveyors 14 trained about rear pulleys 15. Pulleys 12,13 and 15 are mounted on suitable shafts and the conveyors may be driven by any suitable means, not shown.

Station 1 and apparatus 3, as well as station 2, may all be mounted to a supporting structure such as a machine frame 16.

Station 2 is disposed between lift station 1 and conveyor apparatus 3 and is adapted to feed shets 6 one at a time in succession from the top of stack 5 to the conveyor. For this purpose, a pickup head 17 is disposed centrally of the top portion of backup plate 8 and closely thereabove. Head 17 comprises a plurality of horizontal longitudinally spaced rollers 18,19,20 mounted on respective shafts 21,22,23 which are journaled in bearings in the head framework 24.

A motor 25 on the machine frame 16 is connected through a chain 26 to a forwardly disposed transverse shaft 27 which in turn is connected through pulleys 28 and a belt 29 to the front or downstream roller shaft 21 to thereby rotatably drive roller 18. Adjacent pairs of head rollers are also connected via drive belts 30,31 with the result that actuation of motor 25 causes all of the rollers to rotate clockwise when viewed from the direction of FIGS. 1 and 3.

Pickup head 17 is adapted to have its rollers engage the topmost stack sheet 6 and to apply a vacuum thereto. For this purpose, the upper portion of head 17 constitutes an inverted box 32 which overlies the rollers and which is connected through a line 33 to a suitable source of vacuum 34. The box forms a vacuum plenum chamber 35 therein. The front and rear walls of box 32 extend downwardly to closely adjacent rollers 18 and 20 to provide a front and rear seal for the chamber.

Also, the end walls of the box form part of framework 24 and extend downwardly along the ends of rollers 18–20.

In order to permit engagement by the rollers with the topmost sheet 6, the end walls of box 32 terminate slightly above the lowermost extremities of the rollers. However, this leaves end openings which would tend to destroy the effectiveness of the applied vacuum. Therefore, means are provided to effectively seal the ends of the plenum when a sheet 6 engages the head. For this purpose, each end of the head is provided with a floating seal plate 36 which is mounted for relative rotation on shaft 23. The upstream end of each plate 36 is generally circular as at 37, with said end merging in a downstream direction into a generally triangular tapered tongue 38 which terminates just rearwardly or upstream of the plane of backup plate 8. The lower edge 39 of tongue 38 is adapted to float onto the surface of top sheet 6 during the sheet handling and feeding operation to thereby provide the desired end seal. Relative pivoting between each plate 36 and shaft 23 is limited by a pin 40 extending outwardly from the respective box end wall through a curved slot 41 in the respective tongue 38. The top end of each slot 41 provides a stop which limits the downward movement of plate 36 relative to box 32.

Since both seal plates 36 can function independently, they will float on a sheet 6 no matter whether the sheet is flat or warped, thereby effectively sealing even a warped sheet, especially one wherein the curve of the warp extends transversely.

Pickup head 17 is adapted for articulated pivotal movement about a pair of spaced parallel horizontal transverse axes. For this purpose, downstream head shaft 21 forms a primary tilt or pivot axis 42 and transversed shaft 27, which is disposed longitudinally downstream of head 17, forms a secondary tilt or pivot axis 43. As best shown in FIG, 2, shaft 21 extends beyond the end walls of head 17, and shaft 27 is mounted to frame 16. Lever arms 44 extend longitudinally between the outer end portions of the said shafts to thereby connect them. Thus, head 17 is pivotable about primary axis 42, and head 17 and arms 44 are together pivotable about secondary axis 43.

In the normal position of the feeding mechanism, shown in FIGS. 1 and 3, arms 44 are generally horizontal and head 17, which extends upstream thereof, is inclined downwardly at an angle of approximately 5° and is prevented from further downward incline by a pair of spaced upper and lower stop members 45 disposed on box 32 between which is disposed a rigid finger 46 which is secured to and extends upstream from a lever arm 44. When head 17 pivots downwardly relative to arms 44, upper stop 45 engages finger 46 to limit downward head pivoting. By the same token, upon upward pivoting of head 17, relative to arms 44, lower stop 45 engages finger 46 to provide an upper limit of head movement relative to the arms.

Plenum head rollers 18–20 are adapted to engage and drive a top stack sheet 6 downstream, with the transverse outer portions of the sheet's leading edge 47 riding over backup plate 8 and the central sheet portion being directed through a narrow slot 48. The top edge of slot 48 is defined by the lower peripheral portion of head roller 18, while the bottom edge of the slot is defined by a planular plate-like gate 49. Gate 49 is disposed in a rectangular recess 50 formed in the central top edge portion of backup plate 8, and is generally co-planar therewith beneath and preferably spaced slightly downstream from primary axis 42.

Gate 49 is mounted for vertical movement in recess 50. For this purpose, a rectangular framework 52 is pivotally connected between the downstream face of gate 49 and a further downstream portion of main frame 16 to essentially form a parallelogram linkage. A vertical hydraulic gate cylinder 53 is connected between frame 16 and framework 52. Cylinder 53 is supplied with fluid through suitable lines, only the piston head end line 54 being shown. See FIG. 3.

During sheet handling and feeding, as will be more fully described hereinafter, roller 18 will raise and lower. However, it is desired that feed slot 48 maintain the same width at all times. Thus, a servo or slave control is provided so that gate 49 always follows the vertical movement of roller 18. For this purpose, a vertical hydraulic feeder cylinder 55 is connected between frame 16 and a lever arm 44 closely adjacent to roller 18. Cylinder 55 is also supplied with fluid through the usual lines, only the piston head end line 56 being shown. See FIG. 3. Lines 54 and 56 join in a closed loop system whereby when roller 18 and arm 44 move vertically, cylinder 55 is actuated to thereby actuate cylinder 53 and cause gate 49 to exactly follow roller 18 to keep feed slot 48 the same width at all times.

An hydraulic adjustment device 57 is shown as being connected through a line 58 to both lines 54 and 56 whereby increasing the pressure in line 58 will cause the pistons of both cylinders 53 and 55 to move closer together to thereby narrow the width of slot 48. Reducing the pressure in line 58 will widen the slot.

It is contemplated that the stack platform raising mechanism, illustrated herein as cylinder 7, will initially raise stack 5 at a relatively high speed and then will be automatically slowed in response to vertical articulated movement of roller 18 which, in turn, is responsive to engagement by the rising stack. For this purpose, and as best shown in FIG. 3, platform cylinder 7 is connected through a line 59 having a fluid reservoir 60 and pump 61 therein to one side of a valve 62 mounted to frame 16 adjacent the downstream end of one of the lever arms 44. The other side of valve 62 is connected through a line 63 and back to cylinder 7. Valve 62 has a rotary shaft 64 which is connected to a follower arm 65 which extends forwardly to adjacent the upstream end portion of a lever arm 44. A pin 66 on the latter serves as a support for arm 65. See FIG. 2. When roller 18 and arms 44 are raised by sheets 6, follower arm 65 will pivot upwardly, thus rotating valve shaft 64 to gradually restrict the flow of fluid therethrough, which will in turn slow down the platform raising action of the piston of cylinder 7. The higher arm 65 is pivoted, the greater the restriction of valve 62, and vice versa.

OPERATION

Figure 4:
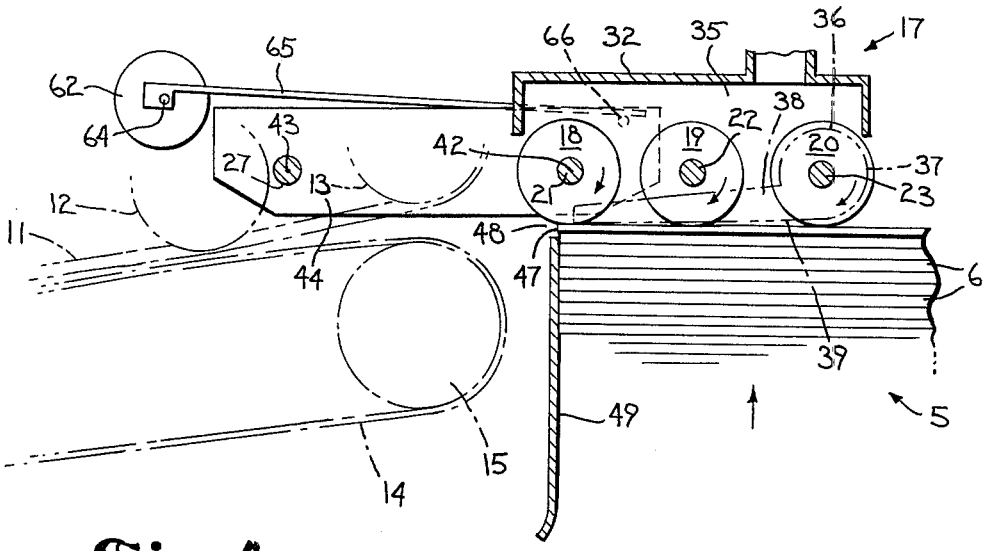
FIG. 4 is an enlarged schematic view and showing the intermediate position of the articulated pickup head slightly after engagement by a rising stack of flat sheets.
Figure 5:
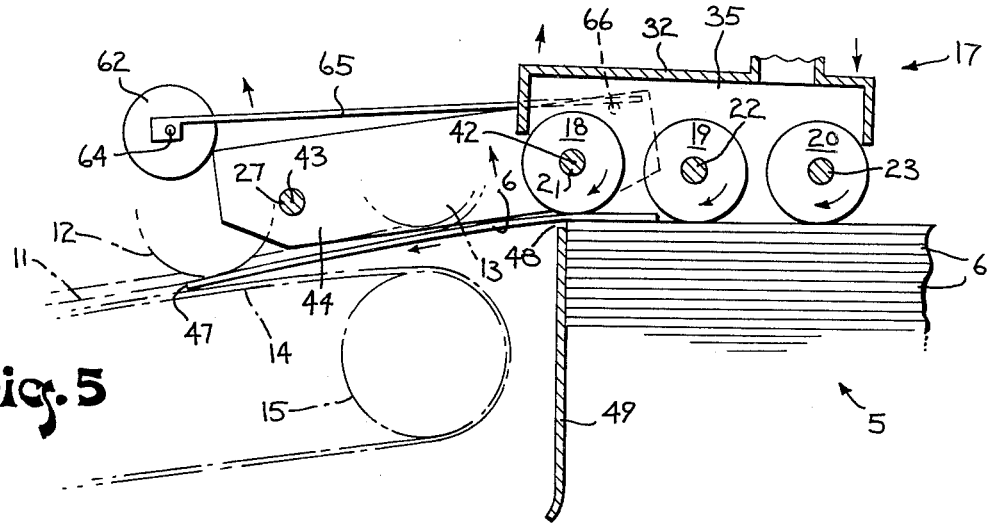
FIG. 5 is a view similar to FIG. 4 and showing a further articulated position of the head.

FIGS. 3, 4 and 5, illustrate in somewhat schematic fashion the operation of the device when sheets 6 are substantially flat. As stack 5 rises at a relatively high speed to closely adjacent head 17 (FIG. 3), tongues 38 will be engaged by topmost sheet 6 to begin the seal vacuum chamber 35. Also, because of the downward incline of head 17, upstream roller 20 will be the first one engaged by the topmost sheet.

Continued high speed raising of the stack causes head 17 to pivot upwardly about primary axis 42 until the head is horizontal (FIG. 4), but axis 42 has not yet moved vertically. During the movement between the positions of FIGS. 3 and 4, the seal caused by floating plates 36 becomes more complete and vacuum within plenum chamber 35 sucks topmost sheet 6 onto the rollers 18–20. Since those rolles are driven, the topmost sheet begins feeding downstream through gate slot 48.

Continued raising of stack 5 causes horizontal head 17 to raise further, but now the linkage arms 44 pivot upwardly about secondary axis 43. This causes arm 65 to restrict valve 62 to reduce the speed of platform raising. Furthermore, the further raising of roller 18 causes gate 49 to move vertically to maintain the same width of gate slot 48 as the sheet passes therethrough. As the sheet progresses downstream (FIG. 5), rollers 19 and 20 drop downwardly onto the next succeeding sheet, thereby causing head 17 to pivot downwardly about primary axis 42. This causes roller 18 to raise even more, thus further restricting valve 62. When the trailing edge of the first sheet 6 has passed through gate slot 48, head 17 drops back to a lower horizontal position, the gate lowers and the stack raising speeds up. This, of course, is only momentary because the presence of the next sheet starts the cycle again.

Figure 6:
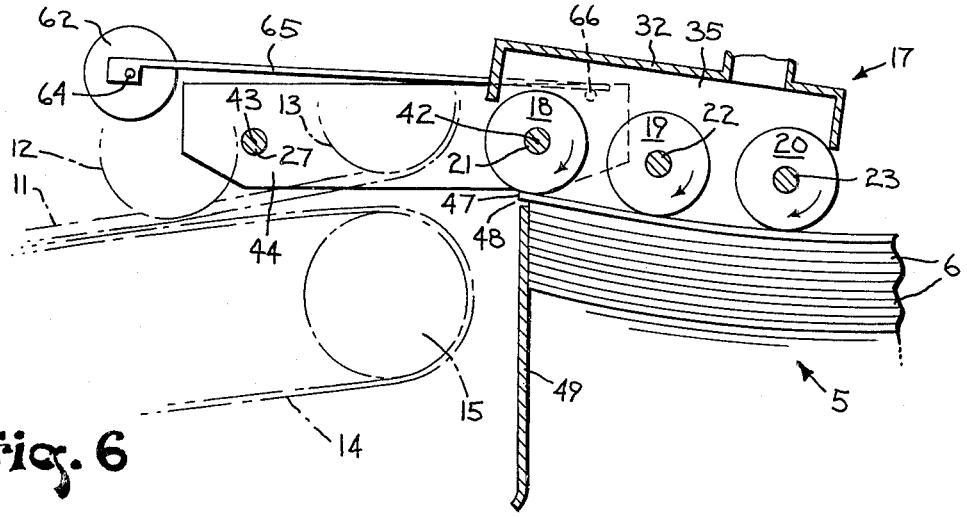

FIGS. 6 and 7 illustrate the operation of the device when one or more upwardly concave sheets with a longitudinal warp curve are presented for feeding. In this instance, and referring to FIG. 5, the stack 6 engages all three rollers before head 17 reaches a horizontal pivoted position. The vacuum seal is created earlier than with flat sheets and the topmost sheet 6 feeds through gate slot 48 toward the conveyors 11 and 14 even though head 17 remains inclined downwardly. The pivotal raising of roller 18 and arms 44 about axis 43 occurs earlier, as does gate raising, and the commencement of platform slowdown. Furthermore, articulated pivoting about axis 42 occurs during a larger part of the feeding cycle.

FIGS. 8 and 9 illustrate the situation when sheets having an upwardly convex longitudinal warp curve are presented to the feeder. In this case, the elements function generally similarly to the previous situations except that head 17 is caused to actually assume an upward articulated tilt about primary axis 42.

The system is so designed that if the longitudinal warp of the sheets is too great for the apparatus to handle, arm 65 will cause valve 62 to entirely close to stop the stack raising function altogether. This prevents jams of warped sheets at the gate.

Turning now to the case of sheets which are warped in a transverse direction, reference is made to FIG. 10. Whether the sheets are upwardly convex, or are upwardly concave as shown in phantom lines, the gripping vacuum action of head 17 flattens the central portion of the flexible sheets sufficiently to permit them to pass through gate slot 48. Furthermore, the top edges 67 of backup plate 8 are inclined downwardly on each side of recess 50, and the inner corners 68 of edges 67 and the outer top corners 69 of gate 49 are bevelled, to accommodate the pass-through or pass-over of upwardly concave sheets without hang up.

In all of the illustrated feeding procedures, head 17 floats atop the rising stack and via double-hinged articulated pivoting about two longitudinally spaced axes, efficiently feeds sheets downstream, whether the sheets be flat or warped in one or more directions. Sheets warped in the direction shown in FIG. 10 may also be warped in the direction shown in FIGS. 5–9, but the concept of the invention makes it possible to handle them all.

While either single or pairs of elements, such as arms, cylinders and the like, have been disclosed herein, any number of such elements may be used without departing from the spirit of the invention.

Various modes of carrying out the invention are contemplated as being within the scope of the following claims particularly pointing out and distinctly claiming the subject matter which is regarded as the invention.

I claim:

1. In a device for feeding sheets of flexible material one-by-one in succession from the top of a rising stack of sheets:

(a) a frame, (b) a vertical backup plate on said frame for aligning the downstream edges of the sheets in the stack, (c) a feeding head extending upstream from above said backup plate, said head including:

(1) vacuum means to separate the topmost sheet of the stack from the next sheet therebelow, (2) and means to drive said topmost sheet downstream from the stack, (d) said sheet driving means comprising:

(1) a plurality of transversely extending rollers with one roller being disposed at the downstream portion of said head, (2) and means to drivingly rotate said rollers to feed the said topmost sheet in a downstream direction, (e) said vacuum means comprising:

(1) a body overlying said rollers and forming a vacuum plenum, (2) and a source of vacuum connected to said plenum, (f) means mounting said head for articulated pivotal movement about a pair of spaced parellel horizontal transversely extending axes upon engagement of the head by a rising stack, (g) and means to adjustably seal the space between the lower portions of the ends of said body and the said topmost sheet upon engagement of said head with said sheet, said sealing means comprising: a seal plate pivotally mounted on each end of said body and with said seal plates being independent of each other, each said seal plate comprising:

(1) an upstream portion pivotally mounted to said body, (2) and a tapered tongue extending downstream from said upstream portion to adjacent said backup plate, (3) said tongue having a lower edge engageable with said topmost sheet.

2. In the device of claim 1:

(a) a vertically movable gate member disposed in a recess centrally of the top portion of said backup plate and generally co-planar therewith, (b) said gate member and the downstream portion of said head defining a transverse gate slot for receiving fed sheets therethrough, (c) said backup plate and said gate member having inclined edge portions disposed adjacent said recess to accommodate passing of upwardly concave sheets through said slot without hang-up.

3. In a device for feeding sheets of flexible material one-by-one in succession from the top of a rising stack of sheets:

(a) a frame, (b) a vertical backup plate on said frame for aligning the downstream edges of the sheets in the stack, (c) a feeding head extending upstream from above said backup plate, said head including:
(1) vacuum means to separate the topmost sheet of the stack from the next sheet therebelow,
(2) and means to drive said topmost sheet downstream from the stack,
(d) said vacuum means comprising:
(1) a body overlying said means to drive said topmost sheet and forming a vacuum plenum,
(2) and a source of vacuum connected to said plenum,
(e) and means to adjustably seal the space between the lower portions of the ends of said body and the said topmost sheet upon engagement of said head with said sheet, said sealing means comprising: a seal plate pivotally mounted on each end of said body and with said seal plates being independent of each other, each said seal plate comprising:
(1) an upstream portion pivotally mounted to said body,
(2) and a tapered tongue extending downstream from said upstream portion to adjacent said backup plate,
(3) said tongue having a lower edge engageable with said topmost sheet.

* * * * *